US005287923A

United States Patent [19]

Cornette et al.

[11] Patent Number: 5,287,923

[45] Date of Patent: Feb. 22, 1994

[54] SAND CONTROL INSTALLATION FOR DEEP OPEN HOLE WELLS

[75] Inventors: H. Mitchell Cornette; Stephen E. Morrison, both of Houston, Tex.

[73] Assignee: Atlantic Richfield Company, Los Angeles, Calif.

[21] Appl. No.: 921,185

[22] Filed: Jul. 28, 1992

[51] Int. Cl.[5] ..... E21B 43/08

[52] U.S. Cl. ..... 166/278; 166/296; 166/227

[58] Field of Search ..... 166/205, 244.1, 278, 166/227, 296, 276

[56] References Cited

U.S. PATENT DOCUMENTS

| | | | |
|---|---|---|---|
| 2,224,630 | 12/1940 | Dean et al. | 166/1 |
| 3,216,497 | 11/1965 | Howard et al. | 166/278 |
| 3,273,641 | 9/1966 | Bourne | 166/278 |
| 3,322,199 | 5/1967 | Van Note, Jr. | 166/276 |
| 3,333,635 | 8/1967 | Crawford | 166/276 |
| 3,880,233 | 4/1975 | Muecke et al. | 166/205 |
| 3,999,608 | 12/1976 | Smith | 166/278 |
| 4,018,282 | 4/1977 | Graham et al. | 166/278 |
| 4,018,283 | 4/1977 | Watkins | 166/278 |
| 4,202,411 | 5/1980 | Sharp et al. | 166/244 |
| 5,062,484 | 11/1991 | Schroeder et al. | 166/278 |

*Primary Examiner*—Ramon S. Britts
*Assistant Examiner*—Frank S. Tsay
*Attorney, Agent, or Firm*—Michael E. Martin

[57] ABSTRACT

Sand control screens temporarily plugged with paraffin wax are installed in deep open hole wells wherein the wax has a melting temperature slightly greater or less than the nominal formation temperature in the zone from which well fluids are to be produced. Drilling fluids and other solids-laden wellbore fluids are removed from the wellbore by flowing the well up through a section of tubing disposed distal of the screen, through the interior of the screen and through the tubing string to the surface until the wellbore is cleaned. The wax is then melted due to the temperature of the produced fluid, is dissolved by the produced fluid or a solvent pumped down through the tubing string or is heated by a heater inserted into the interior of the screen such as a wireline conveyed electric heater. The distal tubing section is plugged so that production fluids are forced to flow through the sand control screen in a conventional manner.

16 Claims, 1 Drawing Sheet

SAND CONTROL INSTALLATION FOR DEEP OPEN HOLE WELLS

BACKGROUND OF THE INVENTION

1. Field of the Invention

The present invention pertains to a method of preferentially plugging a sand control screen for installation in a deep, open hole wellbore using a soluble or meltable screen plugging material which may be removed after clearing the wellbore of screen contaminating fluids, such as drilling mud.

2. Background

In the completion engineering of certain fluid producing wells, it is necessary or desirable to leave the wellbore in an "open hole" condition, that is, without installing and perforating a casing. Where possible, for example, generally horizontally extending wellbores are completed in an open hole condition due to the cost of installing and perforating casing over the substantial length of the fluid producing zone. In generally horizontal, open hole wells that require sand control equipment, so-called pre-packed sand control screens are usually installed at the end of the production tubing. The pre-packed screen not only prevents the production of formation sand into the produced fluid conducted through the tubing but also eliminates the need for a conventional gravel pack as a means of sand control.

However, one significant problem associated with completing an open hole well is the removal of drilling mud from the wellbore so that it does not contaminate and prematurely plug the sand control screen. Most drilling muds contain a weighting medium and a fluid loss control medium which are necessary during drilling but which can clog a sand control screen before substantial production of fluids from the well can begin. Although certain wellbore cleaning fluids can be circulated into the well into the vicinity of the producing zone to remove drilling mud prior to or during a sand control screen installation, these cleaning fluids can be expensive, particularly in deep, open hole wells wherein the formation fluid pressure is significant. The relatively high density brine type fluids preferred for cleaning deep wells may be prohibitively expensive. Accordingly, if the cost of the high density well cleaning fluids can be eliminated together with elimination of casing and perforation procedures in deep wells, the cost of these wells can be significantly reduced. Moreover, the procedures used in completing relatively shallow, horizontal type wells, even with relatively high velocity fluid circulation rates, are usually not effective in deep, generally vertical open hole wells where fluids such as drilling mud, having weighting agents to produce densities of 15 to 18 pounds per gallon, are required for well control.

Known methods to temporarily protectively plug a sand control screen usually require the use of an acid-soluble paste or wax that is painted over the exterior of the screen. Removal of this paste usually requires that acid or a solvent contact the entire exterior of the screen to effect paste or wax removal and this cannot be accomplished by forcing fluid down through the tubing string and out through the screen because the acid or solvent would flow through the small portion of the screen that is first opened and then would enter the formation. The remaining portions of the screen would never be cleaned except, perhaps, unless the acid or solvent was injected using coilable tubing. Coilable tubing operations in deep wells are particularly risky and it is desirable to avoid such operations where possible. If lower density cleaning fluids were to be used to circulate out the drilling fluid or "mud", the well would have to be "killed" after setting the production tubing packer which would then force drilling fluids solids through the inside of the screen and result in the likelihood of plugging the screen from that direction.

Certain developments have been carried out to place fluid impermeable coatings on sand control screens, which coatings can be removed at certain times in the screen installation. For example, U.S. patent application Ser. No. 07/774,393 filed Oct. 10, 1991 in the name of H. M. Cornette and assigned to the assignee of the present invention suggests placing a fluid impermeable paste on the inner surface of an auger type sand control screen to prevent the cross flow of fluid between different formation zones or intervals during screen installation and to prevent the flow of wellbore fluids into the gravel packing and out into the formation during screen installation when the well is in an overbalanced condition.

U.S. Pat. No. 2,224,630 to C. J. Dean, et al, and issued Dec. 10, 1940 describes the placement of a frangible liner on the inner screen surface and filling the screen perforations with a fusible material such as wax or asphalt during screen installation.

U.S. Pat. No. 3,880,233 to T. W. Muecke, et al and issued Apr. 29, 1975 describes provision of a sand control screen wherein a fusible material such as wax is applied to the inner and outer screen surfaces to prevent screen plugging during storage, handling and placement. However, Muecke, et al does not suggest the improvements of the present invention with respect to evacuating drilling fluid from the wellbore after the screen has been installed.

U.S. Pat. No. 4,202,411 to Sharp et al and issued May 13, 1980 describes the provision of a fluid impermeable inorganic matrix such as the reaction product of magnesium oxide and magnesium chloride as a well screen clogging preventative. However, as with the Muecke patent, Sharp et al does not suggest the arrangement or method of the present invention with respect to dealing with the evacuation of drilling fluid in deep open hole wells.

Smith U.S. Pat. No. 3,999,608 issued Dec. 28, 1976 and Schroeder, Jr., et al U.S. Pat. No. 5,062,484 and issued Nov. 19, 1991 deal with methods for gravel packing a well wherein the apertures in the gravel pack liner are sealed to prevent clogging during the installation of the gravel packing around the outside of the liner. Neither of these patents addresses or solves the problem associated with the present invention.

Certain other completion techniques normally used in shallow wells also have disadvantages. Accordingly, there has been a need to develop improved methods for installing sand control screens in deep open hole wells, in particular, to reduce the likelihood of prematurely plugging the screen with remnants of drilling fluid even before the production of formation fluids begins. The present invention solves this problem in a unique manner as will be appreciated by those skilled in the art upon reading the summary and detailed description of the invention which follows herein.

SUMMARY OF THE INVENTION

The present invention provides a unique method for installing a sand control screen in a well, particularly a deep, open hole fluid-producing well.

In accordance with an important aspect of the present invention, a sand control screen is installed in a relatively deep, generally vertical, open hole well wherein the screen perforations are temporarily plugged by a removable medium to prevent premature permanent plugging of the screen fluid flow passages by drilling fluid or other solids laden fluids in the wellbore. The screen installation is provided with a distally disposed tubing section connected to the screen so that drilling fluid may be circulated out of the wellbore by formation fluids without flowing through the screen flow passages and further wherein the distally located tubing section may then be closed to force production fluids to flow through the screen once the temporary screen plugging medium has been removed.

A preferred embodiment of the sand control screen is characterized by a porous material such as sintered metal although conventional wire wrapped or other screen configurations may enjoy the benefits of the present invention.

In accordance with another aspect of the present invention a sand control screen as set forth above is pre-plugged with an easily removable plugging medium, such as paraffin wax, prior to installation of the screen and wherein the plugging medium may be easily removed by melting the plugging medium with produced fluids or another heat source, or injection of a hydrocarbon solvent to dissolve the plugging medium at a predetermined time.

In accordance with still another important aspect of the present invention a pre-plugged sand control screen is provided for use in a fluid-producing well wherein the fluid flow passages in the screen are temporarily plugged with a wax which is meltable at a pre-determined temperature and/or is dissolvable by certain hydrocarbon solvents such as benzene, toluene or xylene.

In accordance with yet a further aspect of the present invention the pre-plugged screen can be opened by generating heat in the vicinity of the screen using a heating device temporarily placed in the screen, heated fluids or certain chemical reactions to generate heat in the vicinity of the screen.

The above noted features and advantages of the present invention together with other superior aspects thereof will be further appreciated by reading the detailed description which follows in conjunction with the drawing.

DESCRIPTION OF PREFERRED EMBODIMENTS

Figure 1:
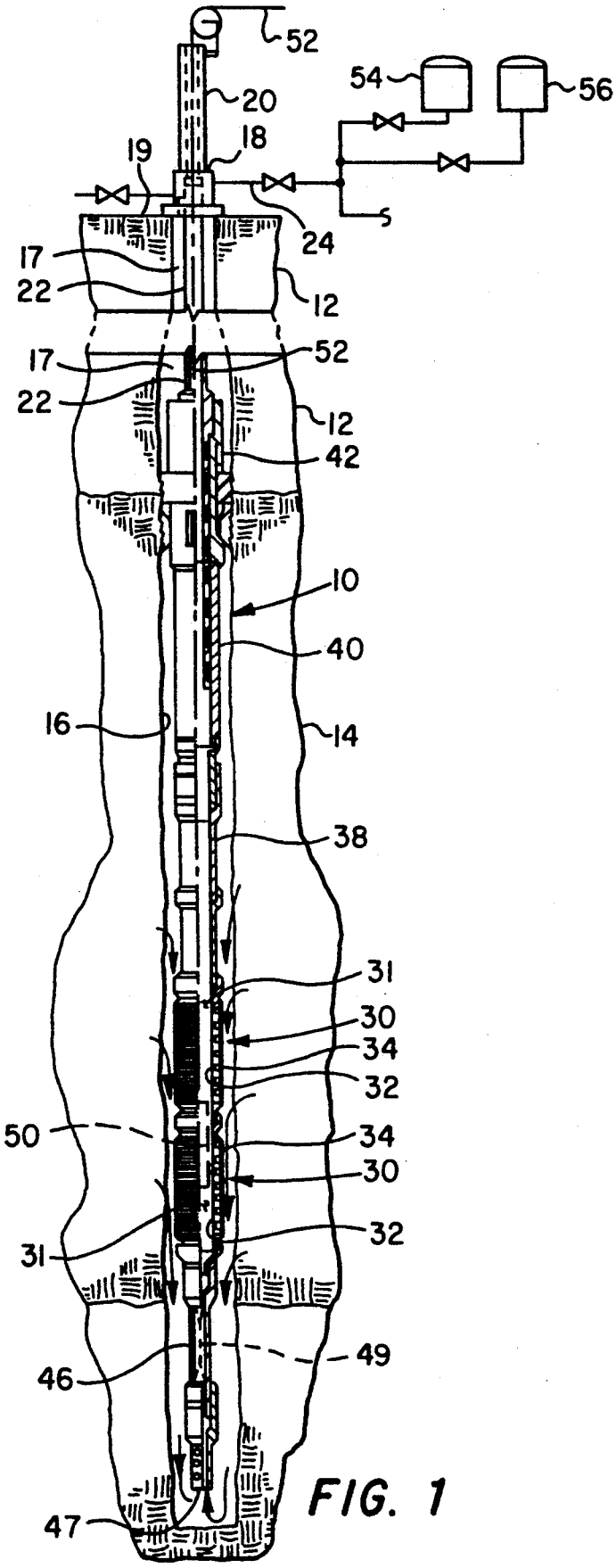
FIG. 1 is a vertical, central section view in somewhat schematic form of a sand control screen installation in a deep, open hole high-pressure well and in accordance with the present invention.

In the description which follows like elements are marked throughout the specification and drawing with the same reference numerals, respectively. Certain elements illustrated in the drawing are shown in somewhat schematic or generalized form in the interest of clarity and conciseness.

Referring to FIG. 1, a sand control installation in accordance with the present invention is shown in place in a deep, generally vertical well 10 extending within an earth formation 12 into and through a zone of interest 14 which is to be produced of certain fluids. The well 10 includes a wellbore portion 16 which has been left in the so-called "open hole" condition, that is, without the installation of a casing or protective pipe to hold the formation material in place. Such completions are often necessary in relatively deep wells due to the necessary small diameter of the wellbore. The well 10 extends from a wellhead 18 at the earth's surface 19 and on which is shown installed a conventional wireline lubricator assembly 20. Fluids may be communicated between the wellbore portion 16 and the surface 19 through a tubing string 22 and a flow line 24 connected to the wellhead 18 in a conventional manner.

The sand control installation of the present invention includes one or more temporarily pre-plugged sand control screens, two shown connected end to end in FIG. 1, each generally designated by the numeral 30. The sand control screens 30 are generally tubular members which are configured to have a perforated base pipe portion 32 defining a central interior flow passage 31 and which is sleeved within a sand control screen portion 34 which may be of a selected type to be described in further detail herein. The sand control screens 30 are connected to the tubing string 22 by conventional, so-called blank pipe sections 38 and a conventional hook-up nipple or pipe section 40 which is connected to a conventional packer 42. One or more tubing sections known in the art as landing nipples 46 are disposed in the sand control installation distally and below the screens 30, as illustrated. The landing nipples 46 are of a type such as an "X" type landing nipple made by Otis Engineering Corporation, Dallas, Tex., which permits the installation of a closure plug 49, FIG. 1, or other flow control device down through the tubing string to be latched in the landing nipple so that flow of formation fluids into the wellbore portion 16 may flow up through the tubing string 22 only by flowing through the sand control screens 30. Of course, prior to installation of the aforementioned closure plug 49, fluids may also flow from the wellbore 16 through the open end 47 of the landing nipple which is secured to the sand control screen 30 in the manner illustrated in FIG. 1. The so called open end 47 may be a conventional pup joint. Accordingly, fluids may flow between the formation zone of interest 14 and the tubing string 22 through the nipple end 47, the interior of the landing nipple 46, the central interior passage 31 of the screens 30, the blank pipe 38, the hook-up nipple 40 and the interior of the packer 42 until the closure plug 49 is inserted in the landing nipple 46. The closure plug 49 may also be available from Otis Engineering Corporation and may be of a pump down type or placed and retrievable by wireline.

Figure 2:
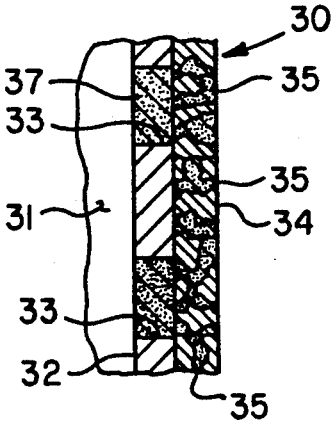
FIG. 2 is a detail section view of a portion of a sand control screen which has been modified in accordance with the present invention.

The screens 30 may take more than one configuration. Basically, the type of screen which would be suitable for the sand control installation of the present invention may be a sintered metal type available from Otis Engineering Corporation under the brand name Howard Smith. FIG. 2 illustrates a detail section of a portion of a screen 30 which has been modified in accordance with the present invention. In FIG. 2 there is shown a portion of the screen base pipe 32 which is provided with suitable perforations or openings 33, a great number of which are formed in the base pipe. The base pipe 32 is sleeved within a sintered metal foraminous screen sleeve 34 which has plural flow passages 35 formed therein. The passages 35 are sized to filter solids including formation sand or other filter mediums such as gravel packing or sand placed in the wellbore around the outside of the screen in some instances. In accordance with the present invention these flow passages 35 together with the orifices or ports 33 are pre-plugged prior to installation of the screen in the wellbore with a suitable medium 37 which is preferably a material which may be easily melted or dissolved, also in accordance with the methods of the present invention.

The medium 37 may, for example, be a relatively low viscosity hydrocarbon wax of the paraffin category, such as a wax made by the Fischer-Tropsch Process and commercially available from Moore and Munger Marketing Inc., Shelton, Connecticut, under the trade names Paraflint H1, Paraflint C1 and Paraflint C2. These waxes are available with congealing points in the range of 187° F. to 230° F., for example. It is contemplated that the screen 30 may be impregnated with the wax 37 to fill the flow passages 35 and 33 prior to installation of the screens 30 into the wellbore portion 16.

Upon installation of the screens 30 into the wellbore, the wellbore portion 16 is typically already filled with high density drilling fluid which typically contains barite or hematite together with calcium carbonate ($CaCo_3$) or starch as a fluid loss control material. In a deep well, such as one penetrating the earth to a depth of about 19,000 feet, for example, the drilling fluid used for such a well would normally be required to have a density of about 17 pounds per gallon. By selecting the plugging medium 37 to have a melting pointy slightly above or comparable to the nominal formation temperature in the producing zone 14, for example, the screens 30 may be installed and the well prepared for unplugging the screen and producing fluid from the zone of interest 14 before melting of the medium 37 occurs. Normally, in completing a well, circulation of drilling fluid in the wellbore will tend to decrease the formation temperature in the immediate vicinity of the wellbore until such circulation stops. A typical period of time for temperatures to stabilize in the wellbore at the nominal formation temperature is about 24 to 36 hours after fluid circulation has ceased. Accordingly, if the melting temperature of the medium 37 is selected to be just at or slightly below the nominal formation temperature in the zone of interest, sufficient time is normally available to install the screens 30, set the packer 42, and remove the resident drilling fluid before the temperature of the fluid in the wellbore in contact with the screen returns to the nominal formation temperature. Moreover, in certain deep, high-pressure (greater than about 5,000 psig), gas producing formations, the formation temperature increases with production. Hence, the wax melting temperature may be set a few degrees higher than nominal formation temperature.

The present invention contemplates other methods of removing the plugging medium 37 from the flow passages 33 and 35. For example, solvents such as benzene, naphtha, pentane, toluene or xylene may be circulated down through the tubing string 22 to contact the medium 37 from the interior of the screen and dissolve the medium to open the screen flow passages. Moreover, it may be possible to dissolve the medium by the production fluid itself. Many formations will produce not only crude oil but certain hydrocarbon condensates such as natural gasolines and the like which also are capable of dissolving the wax medium 37.

Other methods of heating the medium 37 include injecting fluids such as steam or heated oil down through the tubing string 22 to contact the medium from the interior of the screens 30. Sources of steam and solvent or heated oil are indicated at 54 and 56, respectively, in FIG. 1.

Typical examples of the method of providing a sand control installation in a deep, open hole well will now be described in some detail as follows herein.

Prior to installation of the screens 30, each screen would be impregnated with a paraffin-type wax such as of the types described hereinabove and selected to have a melting point at or slightly above the nominal formation temperature in the zone of interest 14. If the formation temperature in the zone of interest 14 is known and is stable, the melting point temperature of the wax may be selected to be that of the formation temperature or slightly less than the formation temperature. This may be done, particularly, if the screen 30 is to be installed within 24 to 36 hours after circulation of drilling fluid is ceased so that the screen may be installed and the well allowed to flow formation fluids to remove the drilling fluid and then melt the wax. If the formation temperature is not accurately known, it is more prudent to select the melting temperature of the wax medium 37 to be 10° to 15° F. greater than the expected formation temperature, for example.

After selecting the wax medium 37 and impregnating the screens 30, the screen installation is performed using conventional procedures involved in installing sand control screens. After the packer 42 is set to seal off the wellbore portion 16 from the remainder of the well annulus above the packer, the well 10 would be prepared for production of fluids also in a conventional manner. Removal of drilling mud and any other fluids in the wellbore portion 16 which might contaminate or plug the screens 30 is then carried out by allowing the well 10 to flow production fluid from the formation zone 14. This flow would be allowed to occur down through the annulus of the wellbore portion 16 into the opening 47 and up through the interiors of the nipple 46, the screens 30 and the remainder of the installation, including the tubing 22, to the surface. If the produced fluid has a temperature at or above the melting point of the medium 37 then this material will eventually melt and open the passages 35 and 33.

Once the well 10 has been flowed sufficiently to clean and remove the drilling fluid (mud) from the wellbore portion 16 in the manner just described, flow is ceased and, if necessary, the medium 37 is removed from the screens 30 using one of the alternate methods described. For example, one of the aforementioned solvents may be pumped down through the tubing string 22. If the temperature of the wellbore portion 16 is now near that of the melting point of the wax medium 37 the wax could be easily removed by differential pressure acting through the screen after inserting the closure plug 49, FIG. 1, into the nipple 46. The differential pressure may be obtained by pumping fluid down through tubing string 22 or by pumping "down" the tubing string to lower the pressure in the passages 31 below that in the wellbore. Alternatively, a heated fluid, such as steam or other fluid which would not be injurious to the screens 30 or the formation zone of interest 14 may also be pumped down through the tubing string 22 to act on the screens 30 to melt or dissolve the wax 37.

Still further, it may desirable to insert an electrically energized heater 50 into the interior of the screens 30 on a wireline 52 and progressively move the heater along the screens to effect melting of the wax material 37 to open the flow passages 35 and 33.

The closure plug 49 would be put in position in the landing nipple 46 using conventional methods such as wireline or by pumping the plug down to the nipple 46 either before or after removal of the wax material 37, depending on the particular procedure used among those described above. If for some reason all of the drilling fluid was not removed from the vicinity of the screens 30 and they should tend to be become plugged with the drilling fluid solids over a period of time, certain acids could be injected down through the tubing string 22 to flow out through the screens 30 to remove the so-called filter cake of solids which would accumulate in and on the screens.

Figure 3:
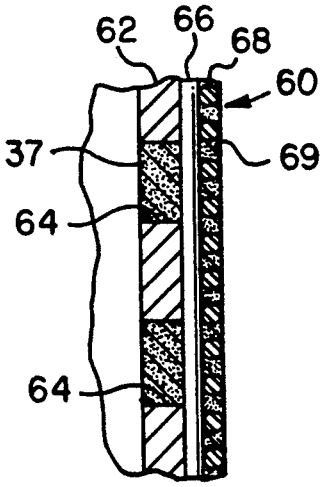
FIG. 3 is a detail section view of another embodiment of a sand control screen which has been modified in accordance with the present invention.

Referring briefly to FIG. 3, an alternate embodiment of a sand control screen is illustrated and generally designated by the numeral 60. Although for certain installations the screen 30 described in conjunction with FIGS. 1 and 2 may be preferred, a more conventional type of wire wrapped screen, such as the screen 60, of either single or dual configuration, may also be used. The screen 60 is of a type which includes a generally tubular base pipe 62 with spaced apart ports or passages 64 formed therein and which is sleeved within a screen formed of longitudinally extending wires 66, one shown in the detail section view of FIG. 3, and transverse wires 68 which may be a continuous wire which is wound around and over the wires 66. This construction forms passages 69 between the wires 68 and which communicate with the passages 64 by way of passages formed between each of the wires 66. As illustrated in FIG. 3 the passage area defined by the screen 60 is also filled with wax material or medium 37.

Although preferred embodiments of a sand control installation and method in accordance with the present invention have been described in detail hereinabove, those skilled in the art will recognize that various substitutions and modifications may be made to the method and the installation configuration without departing from the scope and spirit of the invention as recited in the appended claims.

What is claimed is:

1. In a sand control installation in a relatively deep, open hole wellbore the improvement comprising:

a sand control screen defining many small flow passages for fluid to be produced from a formation, said screen being disposed in said wellbore in the vicinity of said formation to be produced of fluids, said screen including temporary plug means occupying said flow passages of said screen;

a tubing string connected to one end of said screen for conducting said fluids to the earth's surface;

a tail section of said tubing string connected to the opposite end of said screen and defining another flow passage for causing fluids in said wellbore adjacent said screen to flow through said another flow passage and the interior of said screen; and means for closing said another flow passage at will to substantially stop the flow of fluid therethrough.

2. The invention set forth in claim 1 wherein:

said temporary plug means comprises a paraffin wax.

3. The invention set forth in claim 2 wherein:

said paraffin wax has a melting temperature at least one of slightly higher than on slightly lower than the nominal formation temperature in the formation zone of interest.

4. The invention set forth in claim 2 wherein:

said paraffin wax has a melting temperature about the same as the nominal formation temperature in the formation zone of interest.

5. The invention set forth in claim 2 wherein:

said paraffin wax is soluble in the fluid to be produced from the formation zone of interest.

6. The invention set forth in claim 2 wherein:

said paraffin wax is soluble in a solvent consisting of at least one of benzene, naphtha, pentane toluene and xylene.

7. A method of providing a sand control installation in a deep well comprising the steps of:

placing a sand control screen having solids filtering flow passages and a central interior flow passage therein in said well in the vicinity of a formation zone of interest to be produced of fluid, said sand control screen being connected at one end to a tubing string extending to the earth's surface and at an opposite end of said sand control screen to a tail section of said tubing string, said sand control screen being impregnated with a temporary plugging medium occupying said solids filtering flow passages to prevent the flow of solids-laden fluids through said solids filtering flow passages before placing said well in production;

causing said well to flow fluids from said formation zone of interest through said tail section and up through said interior flow passage of said sand control screen and said tubing string to remove said solids-laden fluids from said well adjacent said formation zone of interest;

closing said tail section to the flow of fluids from said formation zone of interest to said interior flow passage;

removing said temporary plugging medium from said solids filtering flow passages of said sand control screen; and causing said well to flow fluids from said formation zone of interest through said solids filtering flow passages of said sand control screen to filter out solids produced from said formation with said fluids.

8. The method set forth in claim 7 including the step of:

inserting closure plug means through said tubing string and said sand control screen to close said tail section of said tubing string to prevent the flow of fluids through said interior flow passage of said sand control screen except through said solids filtering flow passages of said sand control screen.

9. The method set forth in claim 7 wherein:

the step of removing said medium is carried out by melting said medium-by contacting-said sand control screen with fluid produced from said formation zone of interest.

10. The method set forth in claim 7 wherein:

the step of removing said medium is carried out by dissolving said medium with a solvent.

11. The method set forth in claim 10 wherein:

said solvent is introduced to said sand control screen by pumping said solvent down through said tubing string and into said interior flow passage of said sand control screen to contact said medium.

12. The method set forth in claim 7, wherein:

the step of removing said medium is carried out by placing means within said interior flow passage of said sand control screen for generating heat to melt said medium.

13. The method set forth in claim 12 wherein:

the step of placing means within said interior flow passage comprises placing an electric energized heater in said interior flow passage by a wireline and the like.

14. The method set forth in claim 7 wherein:

said medium comprises a wax having a melting point at least one of slightly greater than and slightly less than the nominal temperature of said formation zone of interest and the step of removing said medium from said sand control screen is carried out by generating a differential pressure acting across said solids filtering flow passages.

15. The method set forth in claim 14 including the step of:

lowering the pressure in said tubing string at said sand control screen to be less than the nominal pressure in said well.

16. The method set forth in claim 14 including the step of:

forcing pressure fluid down said tubing string and through said interior flow passage of said sand control screen to forcibly eject said medium from said solids filtering flow passages.

* * * * *